US008137077B2

(12) United States Patent
Wierzchon et al.

(10) Patent No.: US 8,137,077 B2
(45) Date of Patent: Mar. 20, 2012

(54) PORTABLE AIR COMPRESSOR ASSEMBLY AND ASSOCIATED METHOD

(75) Inventors: Peter J. Wierzchon, Morton Grove, IL (US); John Ronn, Arlington Heights, IL (US)

(73) Assignee: Robert Bosch GmbH, Stuttgart (DE)

( * ) Notice: Subject to any disclaimer, the term of this patent is extended or adjusted under 35 U.S.C. 154(b) by 373 days.

(21) Appl. No.: 12/464,169

(22) Filed: May 12, 2009

(65) Prior Publication Data

US 2010/0119384 A1 May 13, 2010

Related U.S. Application Data

(60) Provisional application No. 61/127,865, filed on May 16, 2008.

(51) Int. Cl.

| | |
|---|---|
| ***F04B 53/00*** | (2006.01) |
| ***F04B 39/00*** | (2006.01) |
| ***A45D 19/04*** | (2006.01) |
| ***A47J 47/16*** | (2006.01) |

(52) U.S. Cl. ..... 417/234; 417/572; 137/557; 248/127; 248/145.6

(58) Field of Classification Search ..... 417/234, 417/1, 63, 229, 233, 238, 278, 279; 137/271, 137/269, 376, 557, 565.18, 899.4; 248/127, 248/128, 129, 133, 145.6, 311.2
See application file for complete search history.

(56) References Cited

U.S. PATENT DOCUMENTS

| | | | | |
|---|---|---|---|---|
| 4,790,559 | A * | 12/1988 | Edmonds | 280/655 |
| 5,396,885 | A | 3/1995 | Nelson | |
| 5,518,032 | A | 5/1996 | Berke | |
| 6,582,201 | B2 | 6/2003 | Lucchi | |
| 6,655,925 | B1 | 12/2003 | Robenalt et al. | |
| 6,923,627 | B1 | 8/2005 | Wood et al. | |

FOREIGN PATENT DOCUMENTS

| | | |
|---|---|---|
| EP | 0320579 | 6/1989 |
| GB | 2187258 | 9/1987 |
| WO | 9115895 | 10/1991 |

OTHER PUBLICATIONS

Lowes website pages (DeWalt product); DeWalt 2-Gallon 150 PSI Gas Portable Air Compressor; http://www.lowes.com; published at least as early as May 11, 2009; (3 pages).

Lowes website pages (Hitachi product); Hitachi 8-Gallon 120 PSI Portable Air Compressor; http://www.lowes.com; published at least as early as May 11, 2009; (3 pages).

Patent Cooperation Treaty, International Search Report, International Application No. PCT/US2009/043536, Aug. 8, 2009, 4 pages.

* cited by examiner

*Primary Examiner* — Joseph L Williams
(74) *Attorney, Agent, or Firm* — Maginot, Moore & Beck

(57) ABSTRACT

An air compressor assembly includes a base assembly including a first air cylinder and a second air cylinder each to store compressed air therein. The assembly further includes a first rearward handle and a second rearward handle each being attached to a rearward end portion of the base assembly. The assembly also includes a wheel attached to a forward end portion of the base assembly. In addition, the assembly includes a forward handle attached to the forward end portion of the base assembly. The assembly further includes an engine supported by the base assembly. Also, the assembly includes a pump powered by the engine and configured to generate compressed air which is advanced into the at least one air container.

19 Claims, 6 Drawing Sheets

PORTABLE AIR COMPRESSOR ASSEMBLY AND ASSOCIATED METHOD

This application claims the benefit of priority of U.S. provisional application Ser. No. 61/127,865, filed May 16, 2008, the disclosure which is herein incorporated by reference in its entirety.

FIELD OF THE INVENTION

The present invention relates to a portable air compressor assembly.

BACKGROUND OF THE INVENTION

Compressed air is required to supply pneumatic tools. The air may be supplied by a permanently installed air compression unit or by a portable unit. One such portable unit is a portable air compressor assembly that is mounted on a cart with one wheel and is commonly known as a wheelbarrow-type air compressor or an air compressor wheelbarrow.

Referring to FIG. 4, a prior art wheelbarrow compressor 1 is shown schematically. The wheelbarrow compressor 1 includes a pneumatic wheel 2 on front end 3 of body 4 of wheelbarrow compressor 1 and a pair of spaced-apart cantilevered tubes 5 that extend upwardly and outwardly from rear end 6 of the wheelbarrow compressor 1. The wheelbarrow compressor 1 is powered by an by internal combustion engine 7 which drives a pump 8 that supplies air to a pair of spaced-apart air tanks 9 that serve as part of body 4. The wheelbarrow compressor 1 is moved at the construction site by lifting the rear end 6 of the wheelbarrow compressor 1 by the tubes 5 and rolling it to the desired location. Such wheelbarrow compressors are frequently used by construction crews at construction sites to supply compressed air for air powered tools such as nailers or jackhammers. These portable air wheelbarrow compressors are typically moved from construction site to construction site by a pickup truck. At least two construction workers are typically needed to lift the wheelbarrow compressor onto the truck, one worker lifting each of its ends.

A portable air compressor assembly that may be loaded more easily and/or by only a single worker is desirable.

SUMMARY

In accordance with one embodiment of the disclosure, there is provided an air compressor assembly that includes a base assembly including at least one air container configured to store compressed air therein. The assembly also includes a first rearward handle attached to a rearward end portion of the base assembly. The assembly further includes at least one wheel attached to a forward end portion of the base assembly. In addition, the assembly includes a forward handle attached to the forward end portion of the base assembly. Also, the assembly includes an engine supported by the base assembly. The assembly further includes a pump powered by the engine and configured to generate compressed air which is advanced into the at least one air container. The first rearward handle includes a first handle portion and a second handle portion that define a first notch therebetween, and the first rearward handle further includes a first friction enhancer supported on the first handle portion and located within the first notch.

BRIEF DESCRIPTION OF THE DRAWINGS

The accompanying drawings illustrate various embodiments of the present invention and together with a description serve to explain the principles of the invention. In the drawings.

Corresponding reference characters indicate corresponding parts throughout the several views. Like reference characters tend to indicate like parts throughout the several views.

DETAIL DESCRIPTION OF THE INVENTION

Figure 1:
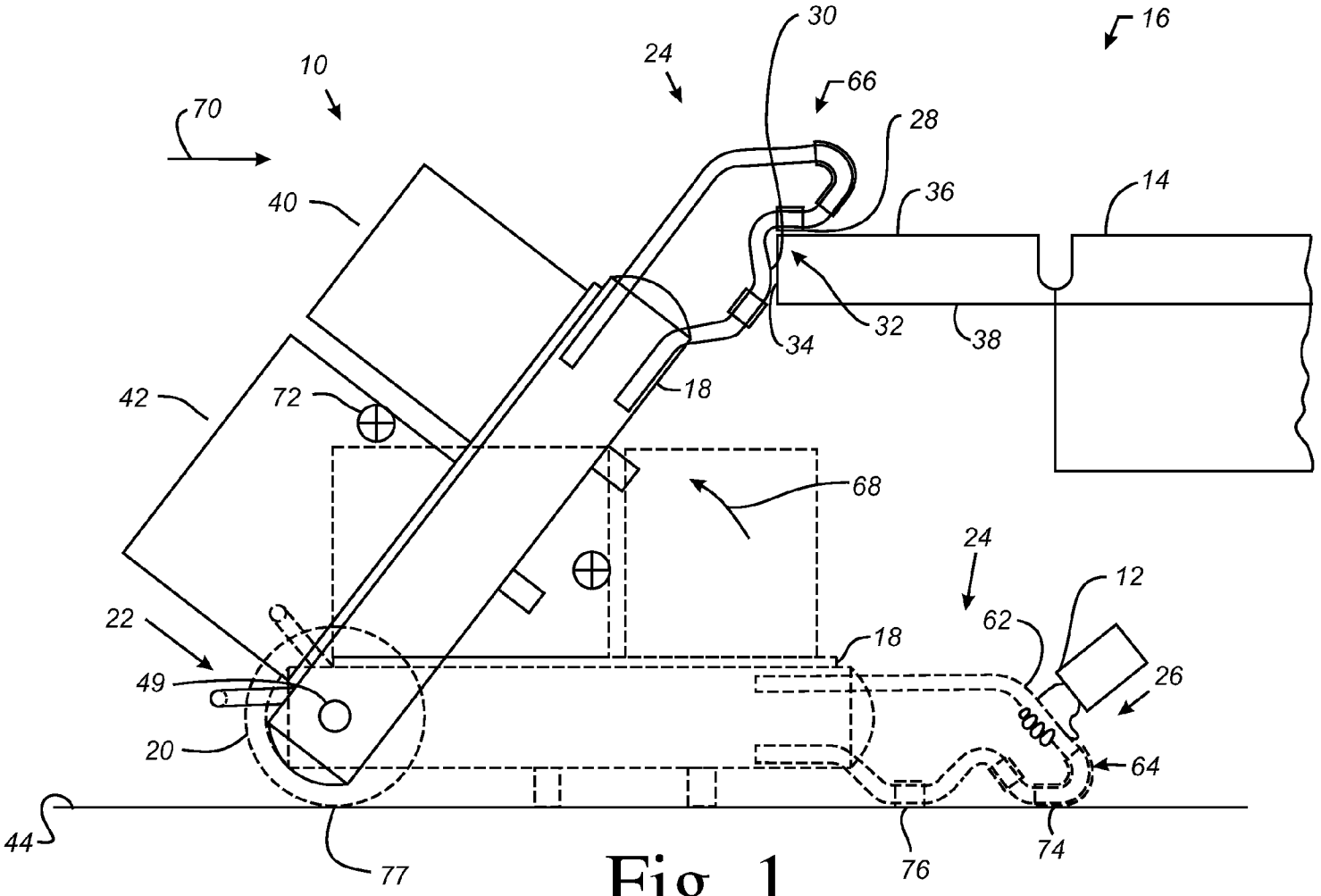
FIG. 1 is a side view of an air compressor assembly shown with a handle engaged with the tailgate of a pickup truck and with the cart shown on the ground in dashed lines.

Reference will now be made in detail to various presently preferred embodiments of the invention, examples of which are illustrated in the accompanying drawings. In the various figures some of the structures are referenced with similar reference numerals.

According to the present invention and referring now to FIG. 1, a portable wheelbarrow-type air compressor assembly 10 that is more easily loaded by an individual 12 into an elevated platform 14 of a vehicle 16 is shown. The vehicle 16 may be a pickup truck and the platform 14 may be the bed of the pickup truck 16. The compressor assembly 10 includes a base 18 with a wheel 20 disposed on a front or first end 22 of the base 18 and a handle 24 on an opposed rear or second end 26 of the base 18. The handle 24 includes a first surface 28 and a spaced-apart second surface 30. The first surface 28 and the second surface 30 form a load assisting notch 32 for cooperation with rear end 34 and top 36 of tailgate 38 of the truck 16. To load the compressor assembly into the truck 16, the handle 24 of the compressor assembly 10 is raised until the notch 32 of the handle 24 aligns with the rear end 34 and top 36 of the tailgate 38. The notch 32 secures the rear end 26 of the compressor assembly 10 while the individual 12 lifts the front end 22 of the compressor level with the top 36 of the tailgate 38 and then slides the compressor assembly 10 into the bed 14 of the truck 16.

As shown in FIG. 1, the portable air compressor assembly 10 includes the base 18, a pump 40, an engine 42 and the handle 24. The pump 40 provides air and is supported by the base 18. The engine 42 powers the pump 40 and the handle 24 is connected to the base 18. The first surface 28 is configured for contact with the upper surface 36 or top of the tailgate 38 of truck 16 on a driving surface 44 and the second surface 30 is separated from the first surface 28 for contact with the rear end 34 of the tailgate 38 of truck 16 when at least a portion of the compressor assembly 10 is positioned on the driving surface 44.

Figure 2:
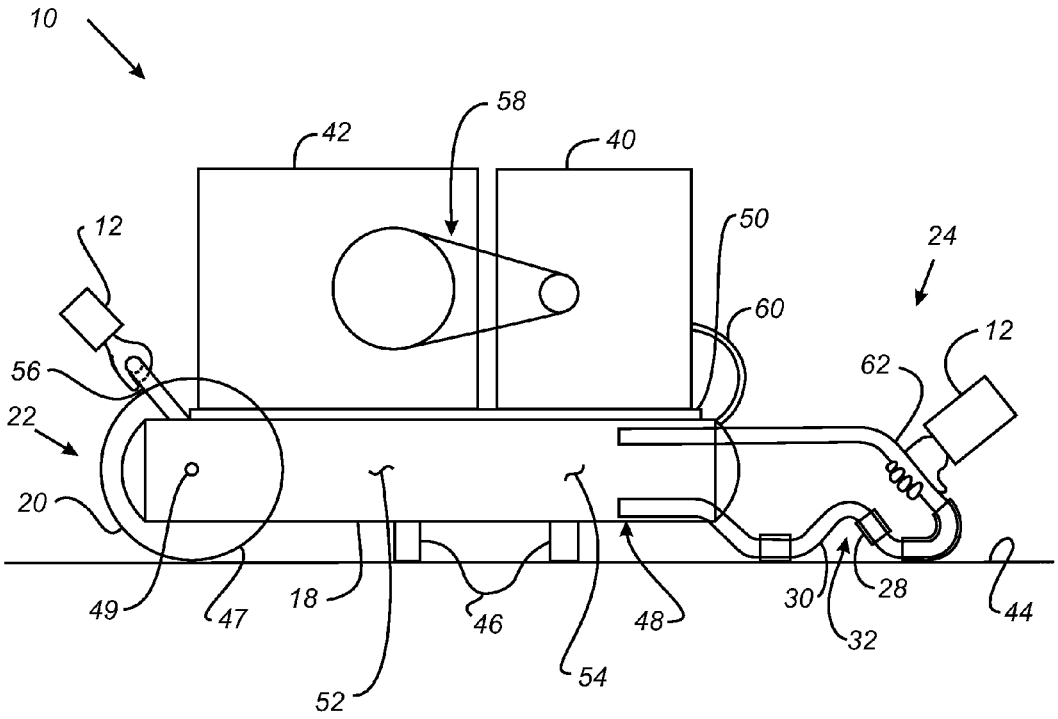
FIG. 2 is a side view of an air compressor assembly of FIG. 1 shown positioned on the ground.

Referring now to FIG. 2, the compressor assembly 10 is designed to operate on the driving surface 44. The compressor assembly 10 utilizes a solitary wheel 20 that is centrally located on the first end 22 of the base 18. Alternatively, two wheels may be used for additional stability. The wheel 20 includes, for example, a pneumatic rubber tire 47. When the compressor assembly 10 is positioned as shown in FIG. 2, the weight of the assembly 10 is primarily supported by intermediate supports 46, with only light contact or force being applied to the wheel 20 to prevent freewheeling thereof due to vibration. Note that when the compressor assembly is being supported by the intermediate supports 46 as shown in FIG. 2, the entire handle 24 is spaced apart from the driving surface 44 by a small distance. This configuration prevents the compressor assembly 10 from undesirably sliding when the assembly 10 is being transported from site to site, as well as, prevents the handle 24 from becoming dirty or scratched due to contact with the driving surface 44.

The base 18 includes an air tank 48 for storing compressed air from the pump 40. The base 18 also includes a plate 50 that lies on top of the tank 48 and supports the engine 42 and the pump 40. The tank 48 includes two spaced-apart cylinders 52 and 54 that are connected by cross-over tube 56. The tank supports an axle 49 about which the wheel 20 rotates.

The engine 42 and the pump 40 may be connected to the plate 50 by fasteners (not shown). The engine 42 is a petroleum fueled engine and may be a two or a four cycle engine. Alternatively, the engine 42 may be replaced by an electrical motor (not-shown). The engine 42 drives the pump 40 through a drive train 58 of belts and pulleys. The pump includes a compressed air output line 60 connected to the tank 48, The handle 24 includes a gripping portion 62 which the individual 12 may grip with his/her hand to move the air compressor assembly 10 to a different position along the driving surface 44. As shown, the handle 24 has a generally "U" shape such that the fingers and knuckles of the individual's hand may be protected by the handle 24 when moving the compressor assembly.

Referring again to FIG. 1, the air compressor assembly 10 is shown in position behind the pickup truck 16 ready to be loaded onto the bed 14 of the truck 16. The compressor assembly 10 is moved from first position 64, as shown in dashed lines, to second position 66, as shown in solid lines, by lifting upward at gripping portion 62 of handle 24 and rotating the compressor assembly 10 in the direction of arrow 68 about axle 49 of wheel 20 until first surface 28 of handle 24 is in alignment with top 36 of tailgate 38 of the truck 16. The compressor assembly 10 is then advanced in the direction of arrow 70 until the second surface 30 of the handle 24 is in contact with rear end 34 of tailgate 38. At this point, the notch 32 of the handle 24 secures the compressor assembly 10 in the second position 66 against the tailgate 38. The air compressor assembly 10 is designed such that it has a center of gravity 72 that is located between the axle 49 of wheel 20 and the notch 32 of handle 24 when the compressor assembly 10 is in the second position 66, so that the notch 32 of handle 24 is urged by gravity in engagement with the top 36 of the tailgate 38.

Figure 3:
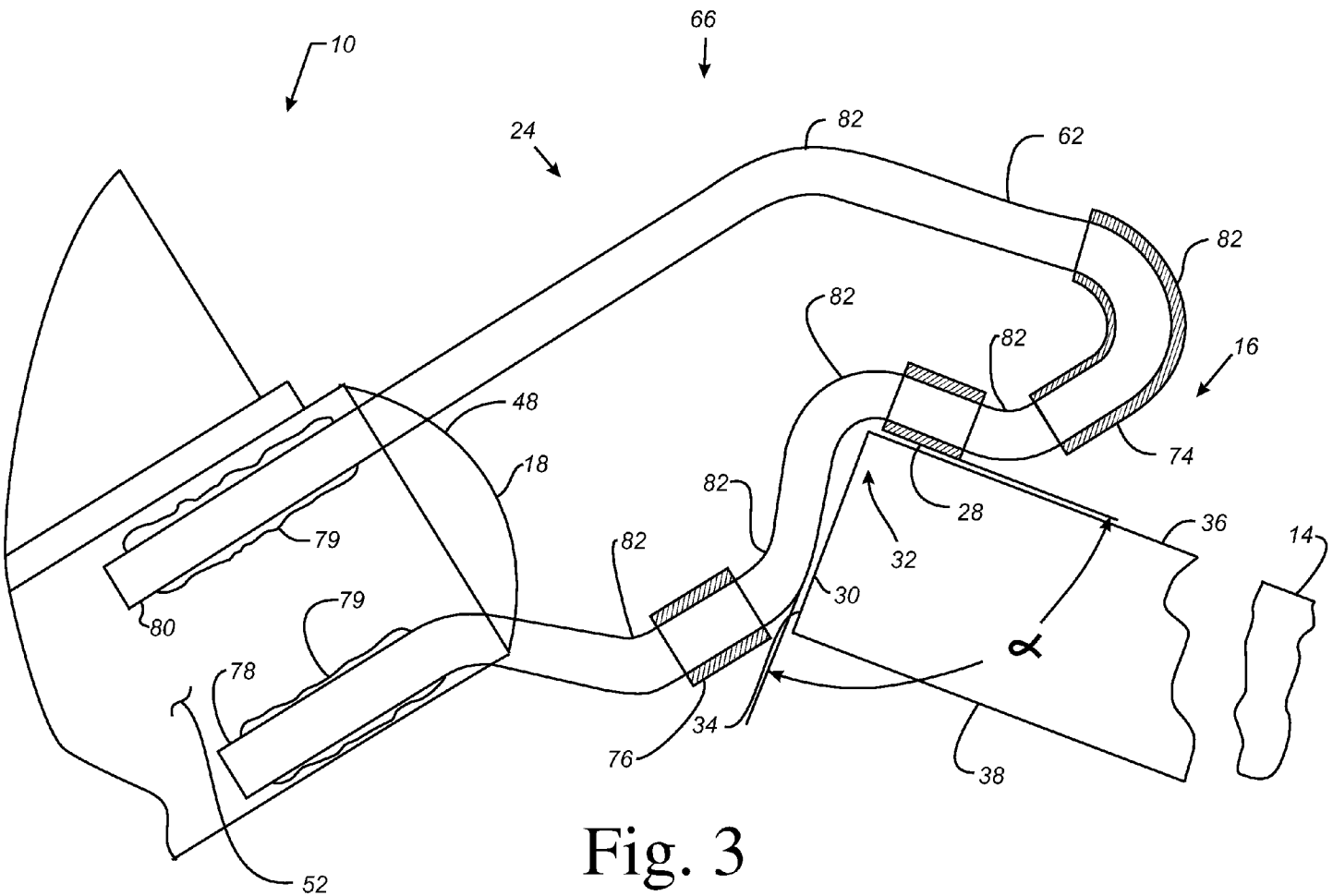
FIG. 3 is a partial plan view of FIG. 1 showing the handle in greater detail.
Figure 4:
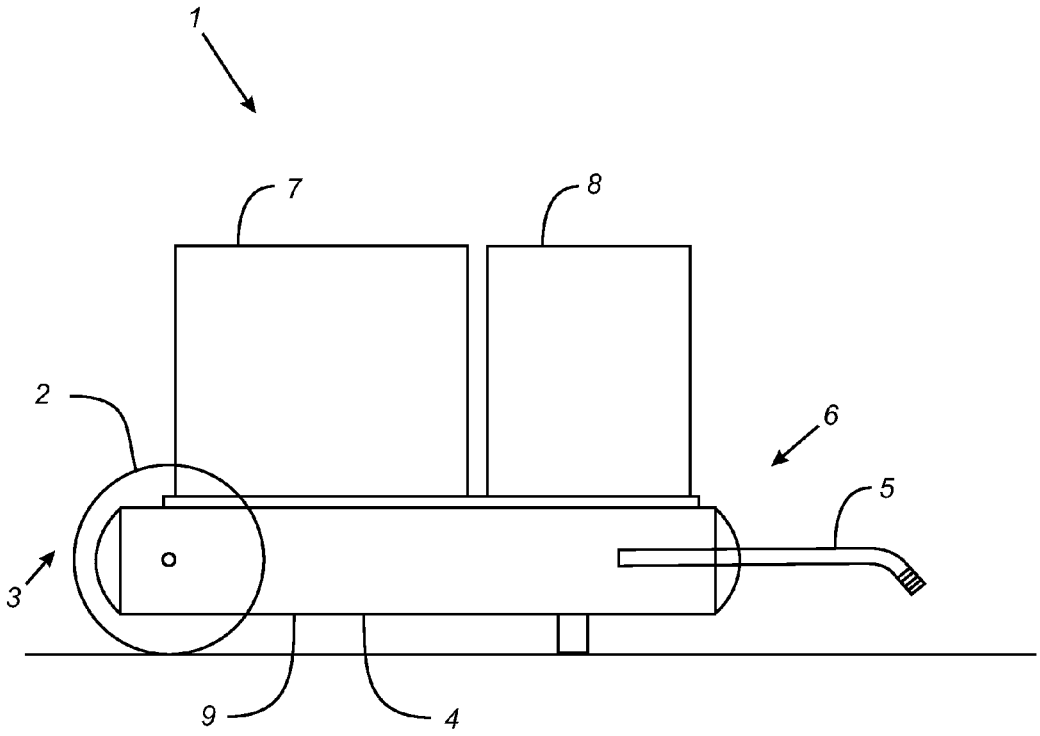
Fig. 4 (Prior Art)
FIG. 4 is a side view of a prior art air compressor assembly.

Referring now to FIG. 3, the notch 32 of the handle 24 is shown in greater detail in second position 66 in engagement with the tailgate 38. The notch 32 is positioned such that first surface 28 of handle 24 is engaged with top 36 of tailgate 38 and second surface 30 of handle 24 is engaged with rear end 34 of tailgate 38. The second surface 30 is positioned between the first surface 28 and the body 18 of the compressor assembly 10. The handle 24 may have any suitable shape to provide the notch 32. The first surface 28 and the second surface 30 define an angle $\alpha$ between the first surface 28 and the second surface 30. The angle $\alpha$, as shown, is around ninety (90) degrees, so that the first surface 28 engages top 36 of tailgate 38 and second surface 30 engages end 34 of the tailgate 38. The angle $\alpha$ may, alternatively, be an acute angle or an obtuse angle. The angle $\alpha$ is less than one hundred eighty (180) degrees, so that the notch 32 may be formed.

The handle 24 further includes a third surface 74 for engagement with the top 36 of tailgate 38. The third surface 74 is positioned between the first surface 28 and the gripping portion 62.

The handle 24 also includes a fourth surface 76 for engagement with the top 36 of tailgate 38. The fourth surface 76 is positioned between the second surface 30 and the body 18 of the compressor assembly 10. Note that when the compressor assembly is being supported by the intermediate supports 46 as shown in FIG. 2, the entire handle 24 including the third surface 74 and the fourth surface 76 is spaced apart from the driving surface 44 by a small distance. As an alternative, the design of the compressor assembly 10 may be modified such that the third and fourth surfaces 74, 76 are positioned in contact with the driving surface 44 when the compressor assembly 10 is being supported by the intermediate supports 46 in a substantially horizontal orientation.

As shown in FIG. 3, the handle 24 has a generally "U" shape with a first end 78 of the handle 24 and a spaced-apart second end 80. The handle 24 is connected to left cylinder 52 of tank 48 by, for example, a weldment 79. The handle 24 may be made of any suitable material or combination of materials, such as metals, polymers, or composite materials. The handle 24 has a tubular cross section and may, alternatively, have a solid cross section. The cross section of the handle may have any suitable shape. For simplicity and as shown, the handle 24 has a tubular, circular cross section. Since the handle 24 has a circular cross section, the first surface 28, the second surface 30, the third surface 74 and the fourth surface 76 provide line contact with their respective mating surfaces. It should be appreciated that if area contact is desired, the surfaces 28, 30, 74 and 76 may be designed with a flat or planar surface for cooperation with their respective mating surfaces.

The first surface 28 is used to secure the compressor assembly 10 in the second position 66 with the first surface 28 engaging the top 36 of tailgate 38. To assist in its role to secure the compressor assembly 10, the first surface 28 may include a surface with a high coefficient of friction with the tailgate 38. For example the surface 28 may have a coefficient of friction greater than 1.0. The surface 28 may be coated with a high friction material, such as rubber. Alternatively, a sleeve made of a high friction material may be wrapped around the first surface 28 of the handle 24.

The third surface 74 and the fourth surface 76 are used to slide the compressor assembly onto the bed 14 of the truck 16. The surfaces 74 and 76 are, therefore, preferably coated with a low friction material, or made from a material having low friction characteristics. For example the surfaces 74 and 76 may have a coefficient of friction with the bed of the truck of less than 0.10. The surfaces 74 and 76 may be coated with a low friction material, such as polytetrafluoroethylene (PTFE). Alternatively a sleeve made of a low friction material may be wrapped around the surfaces 74 and 76 of handle 24. The second surface 30 may slide slightly against the end 34 of the tailgate 38 when raising the compressor assembly 10 to a horizontal position and may, alternatively, be also coated with a low friction material.

The generally "U" shaped handle 24 may have any configuration that results in the surfaces 28, 30, 74 and 76 being oriented as described above. As shown in FIG. 3, the handle 24 has arcuate portions 82 positioned between the second end 80 and the gripping portion 62, between the gripping portion 62 and the third surface 74, between the third surface 74 and first surface 28, between the first surface 28 and second surface 30, between the second surface 30 and fourth surface 76, and between the fourth surface 76 and the first end 78. The arcuate portions 82 provide strength to the handle 24 and facilitate smooth transitional movement of the handle 24 against the tailgate 38 and the bed 14 of the truck 16 as the handle 24 is used to guide the compressor assembly 10 onto the truck 16 as the compressor assembly 10 is loaded. The configuration of the handle 12 facilitates sliding of the compressor assembly 10 on the bed 14 of the truck 16 even when the wheel-side of the compressor assembly is located at a vertical height greater than the vertical height of the handle-side of the compressor assembly.

Figure 5:
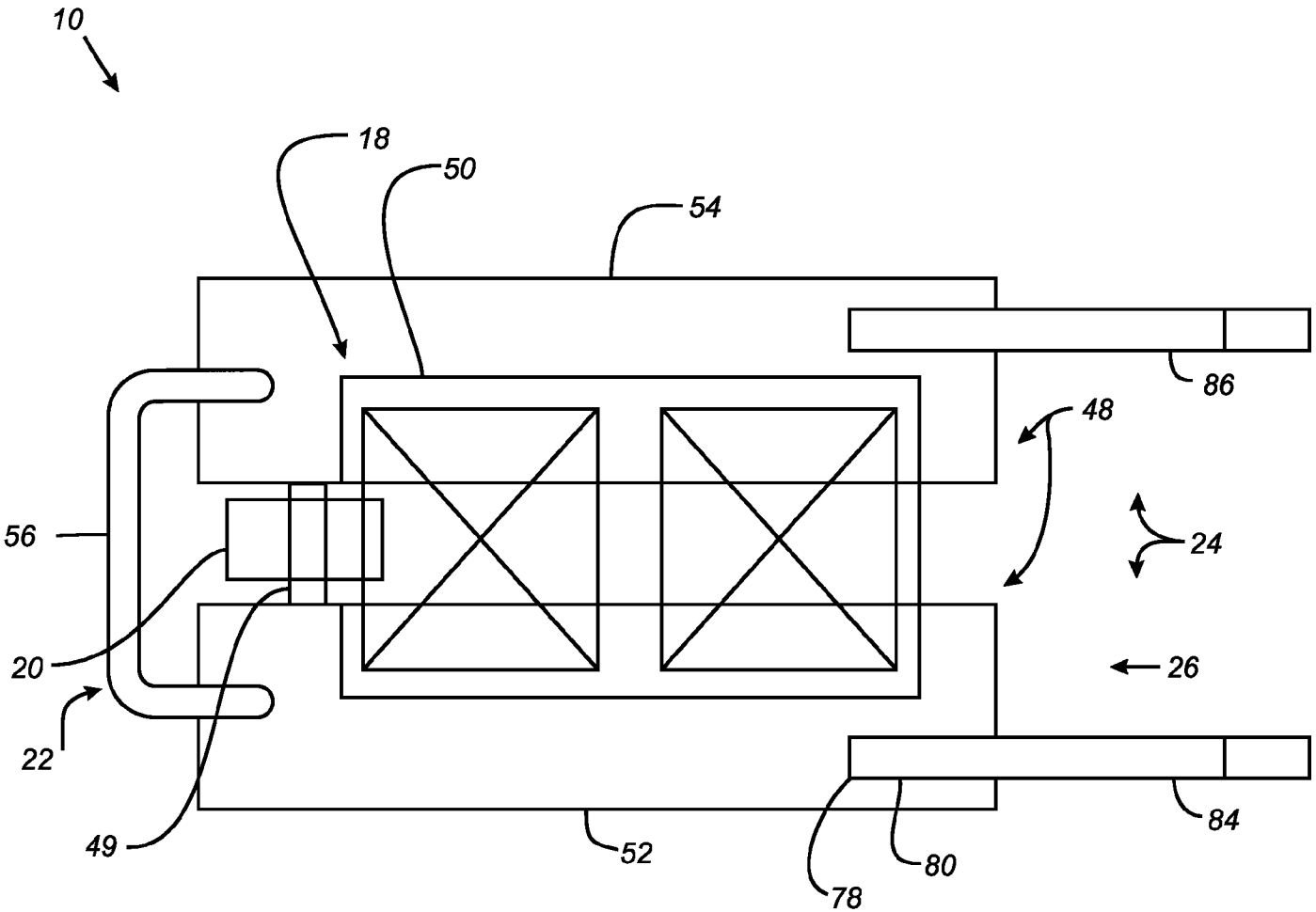
FIG. 5 is a top view of the air compressor assembly of FIG. 1.

Referring now to FIG. 5, the compressor assembly 10 is shown in a top view showing the right cylinder 54 as well as the left cylinder 52. The right cylinder 54 is connected to the left cylinder 52 by the plate 50 that is, for example, welded to the cylinders 52 and 54 to form the base 18. The cross-over tube 56 is, for example, welded to the cylinders 52 and 54 and serves to permit air to pass between the cylinders 52 and 54. The tube 56 also serves as a handle to lift the front end 22 of the compressor assembly 10. The axle 49 is, for example, welded to the cylinders 52 and 54 and supports the wheel 20.

While the compressor assembly of the present disclosure may include a solitary handle, as shown in FIG. 5 the handle 24 includes a left handle 84 as well a spaced-apart right handle 86. For simplicity, the right handle 86 is identical to the left handle. In FIGS. 1-3 the handle 24 shown is left handle 84. It should be appreciated that the right handle 86 shown in FIG. 5 has the same features as the left handle 84 of FIGS. 1-3 including the notch 32 and the four surfaces 28, 30, 74, and 76. The right handle 86 is secured to the right cylinder 54 by, for example weldments (not shown) similar to weldments 79 (see FIG. 3).

Referring again to FIG. 5, it should be appreciated that the individual may, alternative, move the compressor assembly 10 by lifting on only the left handle 84 or only the right handle 86. Preferably, the compressor assembly 10 is lifted by simultaneously lifting on both handles 84 and 86. It should be appreciated that a compressor assembly 10 with the left handle 84 and the right handle 86 that are spaced apart from each other provides stabilization to the compressor assembly 10, when it is in second position 66 (see FIG. 1) with the notch 32 engaged in the tailgate 38. It should be appreciated that a single handle may be sufficient, if the compressor assembly has a pair of spaced-apart wheels to stabilize the compressor assembly.

Figure 6:
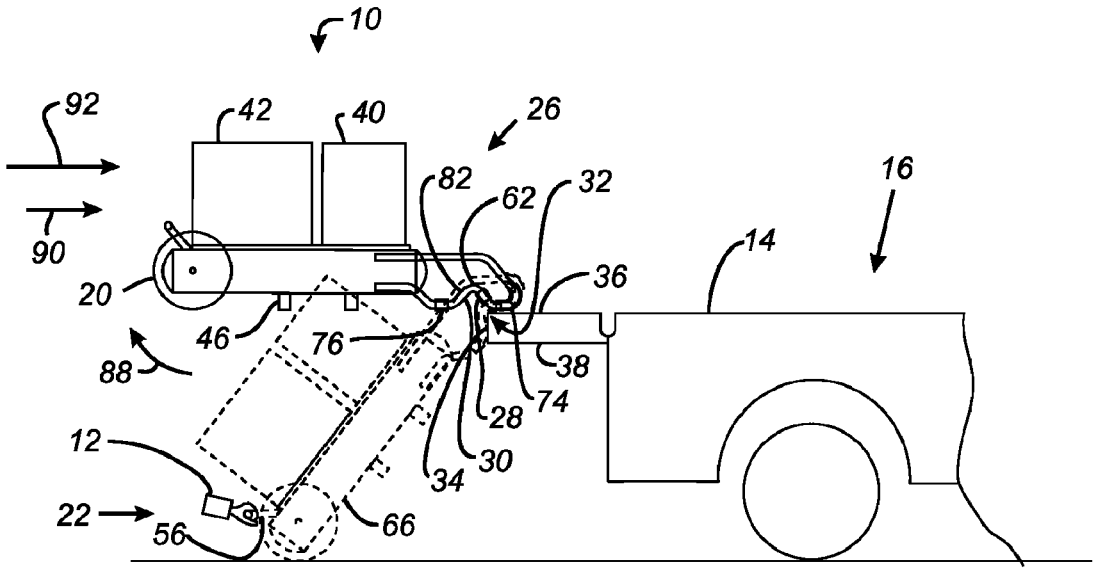
FIG. 6 is a side view of the air compressor assembly of FIG. 1 shown in phantom with first support surface of a handle engaged with the tailgate of a pickup truck, and in solid with the cart in a horizontal position ready to be pushed onto the bed of the truck.

Referring now to FIG. 6, the compressor assembly 10 is shown being further loaded onto the truck 16 by a solitary individual 12. The compressor assembly 10 is shown in dashed lines in second position 66 with the notch 32 engaging the tailgate 38. While the compressor assembly 10 is in second position 66 with the compressor assembly 10 safely secured in the notch 32, the individual 12 may release his grip on the gripping portion 62 of the handle 24 and move toward the front end 22 of the compressor assembly 10. Once at the front end 22, the individual 12 may lift on cross-over tube 56 of the compressor assembly 10 in the direction of arrow 88. As the compressor assembly moves in the direction of arrow 88, the second surface 30 of handle 24 separates from end 34 of tailgate 38 and the first surface 28 of the handle 24 separates from top 36 of tailgate 38.

It should be appreciated that as the compressor assembly moves in the direction of arrow 88, the support of the rear end 26 of the compressor assembly on the tailgate 38 moves from the first surface 28 to the third surface 74. It should be appreciated that the arcuate portion 82 of the handle 24 between the first surface 28 and the third surface 74 provides support for the front end 22 of the compressor assembly during the movement in the direction of arrow 88. The arcuate portion 82 of the handle 24 between the first surface 28 and the third surface 74 may also include a high friction surface similar to that of the first surface 28 to help the individual 12 stabilize the compressor assembly 10 while moving it in the direction of arrows 88.

The individual 12 continues to advance the compressor assembly 10 in the direction of arrow 88 until it arrives at third position 90 in which the wheel 20, the intermediate supports 46, as well as the fourth surface 76 of the handle 24, are in the same horizontal plane as the top 36 of tailgate 38. At this point, the compressor assembly is advanced onto the bed 14 in the direction of arrow 92.

Figure 7:
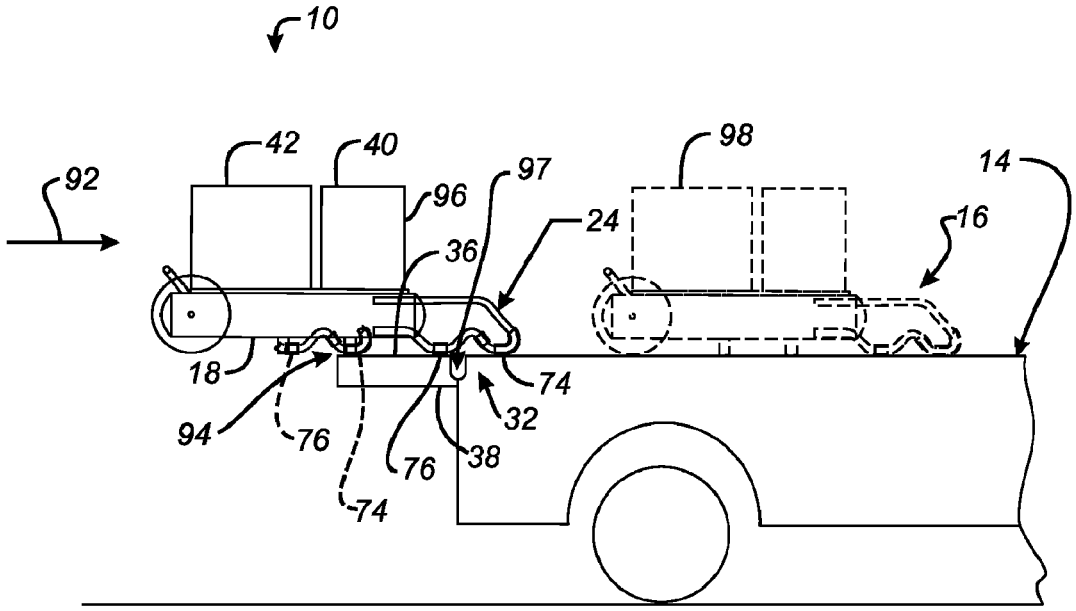
FIG. 7 is a side view of an air compressor assembly of FIG. 1 shown with the fourth support surface of the handle contacting the tailgate and the third support surface of the handle contacting a bed surface of the pickup truck, with the cart in a horizontal position, partially in the bed of the truck, and shown with the cart in phantom, fully loaded on the bed of the truck.

Referring now to FIG. 7, the handle 24 of the compressor assembly 10 is shown in dashed lines in fourth position 94, partially advanced onto the bed 14. In the fourth position 94, the fourth surface 76 of the handle 24 is advanced into contact with the top 36 of tailgate 38 while the third surface 74 of the handle is still positioned on the top 36 of tailgate 38. As the compressor assembly is further advanced in the direction of arrow 92, the third surface 74 of the handle 24 slides off of the top 36 of tailgate 38 into gap 97 between the tailgate 38 and the bed 14. The fourth surface 76 engages the top 36 of tailgate 38 and provides support for the handle 24 of the compressor assembly 10 when the third surface 74 is over the gap 97. The contact of fourth surface 76 against top 36 of tailgate 38 prevents the third surface 94 from falling into the gap 97.

As the compressor assembly 10 is further advanced in the direction of arrow 92, the third surface 74 of the handle 24 slides onto the bed 14 of the truck 16 and onward to the fifth position 96, as shown in solid. In this fifth position 96, the fourth surface 76 is on top 36 of tailgate 38. Finally, the compressor assembly 10 is advanced further in the direction of arrow 92 until the compressor assembly 10 is in sixth position or transport position 98 as shown in phantom on the bed 14 of the truck 16.

It should be appreciated that the compressor assembly 10 may thus be safely loaded onto the bed 14 of the truck 16 by a sole individual using the compressor assembly 10 of the present disclosure and the procedure described herein. It should be further appreciated that compressor assembly 10 may, likewise, be removed from the truck 16 using the procedure described herein, in reverse.

While the handle described herein above in the present disclosure is fitted onto a wheelbarrow-type portable air compressor assembly, it should be appreciated that that handle and loading procedure of the present disclosure may be used on any one-wheeled or two-wheeled cart for any purpose. Further, the cart may be a traditional wheelbarrow with a single wheel or a cart with two wheels.

There is a plurality of advantages arising from the various features of each of the embodiments of the cart and handle described herein. It will be noted that alternative embodiments the cart and handle may not include all of the features described yet still benefit from at least some of the advantages of such features. Those of ordinary skill in the art may readily devise their own implementations of the cart and handle that incorporate one or more of the features described herein.

Representative Concepts of the Disclosure

The present disclosure provides a portable air compressor assembly that is more easily loaded by a single individual into a vehicle, for example a pickup truck. The compressor assembly includes a base with a wheel disposed on a first end of the base and a handle on an opposite end of the base. The handle includes a first and a second surface. The portable air compressor assembly is rolled toward the truck. The handle is lifted toward an opened tailgate of the truck. The first surface of the handle is placed on the top surface of the opened tailgate and the second surface is placed against an end of the opened tailgate. The first end of the base is then lifted and the compressor assembly is pushed into the truck According to an embodiment of the disclosure, a portable air compressor assembly includes a base, a pump, an engine, and a handle. The pump provides air and is supported by the base. The engine powers the pump and the handle is connected to the base. The handle includes a first surface configured for contact with the upper surface of a raised platform of a vehicle on a driving surface and a second surface, separated from the first surface, for contact with an end surface of the platform when at least a portion of the compressor assembly is positioned on the driving surface.

According to an aspect of the disclosure, the first surface and the second surface define an acute angle or an obtuse angle between the first surface and the second surface.

According to another aspect of the disclosure, the first surface is normal to the second surface.

According to another aspect of the disclosure, the base is an air tank.

According to another aspect of the disclosure, the air compressor assembly includes a wheel connected to the base.

According to another aspect of the disclosure, the air compressor assembly defines a center of gravity of the air compressor assembly when engaged with the platform. The center of gravity is positioned between the wheel and the end surface of the platform.

According to another aspect of the disclosure, the first surface of the handle is tangent to the periphery of the wheel.

According to another aspect of the disclosure, the handle further includes a third surface, spaced from the first surface and the second surface. The third surface is tangent to the periphery of the wheel.

According to another aspect of the disclosure, the first surface and the second surface are positioned between the wheel and the third surface.

According to another aspect of the disclosure, the handle further includes a fourth surface spaced from the third surface, the second surface, and the first surface. The fourth surface is parallel to the third surface.

According to another aspect of the disclosure, the fourth surface has a low friction surface.

According to another aspect of the disclosure, the fourth surface has a coefficient of friction of 0.10 or less.

According to another aspect of the disclosure, the fourth surface is positioned between the second surface and the wheel.

According to another aspect of the disclosure, the third surface has a low friction surface.

According to another aspect of the disclosure, the third surface has a coefficient of friction of 0.10 or less.

According to another aspect of the disclosure, the first surface has a high friction surface.

According to another aspect of the disclosure, the first surface has a coefficient of friction of 1.0 or greater.

According to another embodiment of the disclosure, a portable air compressor assembly includes a base, a pump, an engine, a wheel, and a handle. The pump provides air and is supported by the base. The base includes a number of air tanks. The engine powers the pump. The wheel and the handle are connected to the air tanks. The handle includes a first surface tangent to the periphery of the wheel, a second surface separated from the first surface, and a third surface separated from the first surface and the second surface. The first surface and the second surface define a first acute angle between the first surface and the second surface. The first surface and the third surface define a second acute angle between the first surface and the third surface. The second surface and the third surface defining a platform engaging angle between the second surface and the third surface.

According to an aspect of the present disclosure, the second surface and the third surface define one of an acute angle and an obtuse angle between the second surface and the third surface.

According to an aspect of the present disclosure, the second surface is normal to the third surface.

According to an aspect of the present disclosure, the air compressor assembly defines a center of gravity of the compressor assembly when the second surface and the third surface of the handle are engaged with a platform of a vehicle. The center of gravity is positioned between the wheel and the third surface of the handle.

According to another aspect of the present disclosure, a cart includes a base, a wheel connected to the base, and a handle. The handle is connected to the base. The handle includes a first surface tangent to the periphery of the wheel, a second surface separated from the first surface, and a third surface separated from the first surface and the second surface. The first surface and the second surface define a first acute angle between the first surface and the second surface. The first surface and the third surface define a second acute angle between the first surface and the third surface. The second surface and the third surface define a platform engaging angle between the second surface and the third surface.

According to an aspect of the present disclosure, the second surface and the third surface define an acute angle or an obtuse angle between the second surface and the third surface.

According to an aspect of the present disclosure, the base is a container for containing items.

According to an aspect of the present disclosure, the cart defines a center of gravity of the cart when the second surface and the third surface of the handle are engaged with a platform of a vehicle. The center of gravity is positioned between the wheel and the third surface of the handle.

According to another aspect of the present disclosure, the handle further includes a fourth surface spaced from the first surface, the second surface, and the third surface. The fourth surface is parallel to the first surface.

What is claimed is:

1. An air compressor assembly, comprising:

a base assembly including at least one air container configured to store compressed air therein;

a first rearward handle fixedly attached to a rearward end portion of said base assembly;

at least one wheel attached to a forward end portion of said base assembly;

a forward handle attached to said forward end portion of said base assembly;

an engine supported by said base assembly; and a pump powered by said engine and configured to generate compressed air which is advanced into said at least one air container;

wherein:

said first rearward handle includes a first handle portion and a second handle portion that define a first notch therebetween;

said first rearward handle further includes a third handle portion and a fourth handle portion spaced apart from said first notch;

said first notch is interposed between said third handle portion and said fourth handle portion;

said third handle portion includes a first contact surface and said fourth handle portion includes a second contact surface; and said first contact surface and said second contact surface are arranged substantially parallel to each other.

2. The assembly of claim 1, wherein:

said first rearward handle further includes a first friction enhancer supported on said first handle portion and located within said first notch.

3. The assembly of claim 2, wherein:

said first friction enhancer includes a first sleeve positioned around said first handle portion, and at least a portion of said first sleeve is located within said first notch.

4. The assembly of claim 2, further comprising a second rearward handle attached to said rearward end portion of said base assembly, wherein:

said second rearward handle includes a third handle portion and a fourth handle portion that define a second notch therebetween, and said second rearward handle further includes a second friction enhancer supported on said third handle portion and located within said second notch.

5. The assembly of claim 4, wherein:

said first friction enhancer includes a first sleeve positioned around said first handle portion, at least a portion of said first sleeve is located within said first notch;

said second friction enhancer includes a second sleeve positioned around said third handle portion, and at least a portion of said second sleeve is located within said second notch.

6. The assembly of claim 4, wherein both said first friction enhancer and said second friction enhancer includes a coating of high friction material.

7. The assembly of claim 6, wherein said coating includes rubber.

8. The assembly of claim 2, wherein:

said first rearward handle further includes a first friction reducer supported on said third handle portion and spaced apart from said first notch.

9. The assembly of claim 8, wherein:

said first rearward handle further includes a second friction reducer supported on said fourth handle portion and spaced apart from said first notch.

10. The assembly of claim 9, wherein:

said first friction reducer is positioned around said third handle portion, and said second friction reducer is positioned around said fourth handle portion.

11. The assembly of claim 8, wherein said first friction reducer is positioned around said third handle portion.

12. The assembly of claim 9, wherein each of said first friction reducer and said second friction reducer includes a coating of low friction material.

13. The assembly of claim 12, wherein said coating includes polytetrafluoroethylene (PTFE).

14. The assembly of claim 1, wherein:

said base assembly further includes an additional air container configured to store compressed air therein, and said second handle includes a tube connected to both said at least one air container and said additional air container so that said at least one air container is in fluid communication with said additional air container via said tube.

15. The assembly of claim 14, wherein:

said at least one air container includes a first air cylinder, said additional air container includes a second air cylinder, said base assembly further includes a plate supported on said first air cylinder and said second air cylinder, said engine is supported on said plate, and said pump is supported on said plate.

16. The assembly of claim 1, wherein said engine is an internal combustion engine operatively connected to said pump to power said pump.

17. The assembly of claim 1, wherein said first rearward handle possesses a tubular cross section.

18. The assembly of claim 1, wherein:

said base assembly further includes a plate supported on said air container, said engine is supported on said plate, and said pump is supported on said plate.

19. The assembly of claim 1, wherein said pump is in fluid communication with said at least one air container.

* * * * *